US006390331B2

(12) United States Patent
Schütz

(10) Patent No.: US 6,390,331 B2
(45) Date of Patent: May 21, 2002

(54) TRANSPORT AND STORAGE CONTAINER FOR LIQUIDS

(75) Inventor: Udo Schütz, Selters-Westerwald (DE)

(73) Assignee: Protechna S.A., Fribourg (CH)

( * ) Notice: Subject to any disclaimer, the term of this patent is extended or adjusted under 35 U.S.C. 154(b) by 0 days.

(21) Appl. No.: 09/728,489

(22) Filed: Dec. 1, 2000

(30) Foreign Application Priority Data

Dec. 4, 1999 (DE) ..... 199 58 491

(51) Int. Cl.[7] ..... B65D 90/20

(52) U.S. Cl. ..... 222/105; 222/94; 222/185.1; 220/1.6; 220/9.1; 220/495.05; 220/495.06; 220/661

(58) Field of Search ..... 222/94, 105, 185.1; 220/1.6, 9.1–9.3, 495.05, 495.06, 661

(56) References Cited

U.S. PATENT DOCUMENTS 4,516,692 A * 5/1985 Croley ..... 222/105
4,765,507 A * 8/1988 Yavorsky et al. ..... 220/661
5,375,741 A * 12/1994 Harris ..... 222/105
5,586,690 A * 12/1996 Ettore et al. ..... 222/105
5,653,354 A * 8/1997 Olson ..... 220/9.1
5,746,343 A * 5/1998 Watke et al. ..... 220/9.2

FOREIGN PATENT DOCUMENTS

DE 197 22 194 C2 3/1999

* cited by examiner

*Primary Examiner*—J. Casimer Jacyna
(74) *Attorney, Agent, or Firm*—Friedrich Kueffner

(57) ABSTRACT

A transport and storage container for liquids has a flexible inner container of an inner envelope of plastic material and an outer envelope of a woven material. The container also has a cage of crossing horizontal and vertical cage rods of metal as well as a pallet underframe of metal. The flexible inner container is suspended from cover rods connected at the upper frame of the cage of the transport container. The outflow socket of the inner container is detachably connectable with a holding device on the cage of the transport container.

12 Claims, 8 Drawing Sheets

TRANSPORT AND STORAGE CONTAINER FOR LIQUIDS

BACKGROUND OF THE INVENTION

1. Field of the Invention

The invention relates to transport and storage containers for liquids, comprising a pallet-like underframe which is configured to be handled by means of a stacker truck, a shelf servicing device or similar transport means, an inner container of plastic material with a fill socket and an outflow socket which are both closable, and a cage resting against the inner container and comprised of crossing horizontal and vertical cage rods of metal.

2. Description of the Related Art

From German patent DE 19722 194 C2 transport and storage containers of the aforementioned kind are known which comprise a blow-molded inner container of plastic material and are designed for storage and transport of liquids of all kinds in the chemical, pharmaceutical, petroleum, and foodstuff industries.

The stringent environmental laws and regulations require a transition from single-use containers, such as pallet containers and barrels, for the transport and storage of liquids of different kinds to multi-use containers, the conversion to containers of greater volume with the goal of reducing the residual amounts, and the development of new multi-use containers which, with respect to relieving the environment with regard to harmful substances, can be reconditioned and whose plastic components contaminated by the transported and stored liquid goods can be disposed off in an optimal way by a contaminant-reduced or even contaminant-free disposal method, for example, by combustion.

SUMMARY OF THE INVENTION

It is an object of the present invention to further develop the transport and storage container of the aforementioned kind with respect to economical reconditioning by means of a cost-effective manufacture and an optimal disposal of the plastic inner container as well as with respect to fulfilling highest requirements of transport safety.

In accordance with the present invention, this is achieved in that the transport and storage container for liquids has a flexible inner container of plastic material as well as a holding device, detachably connected to the cage, for the outflow socket of plastic material attached to the inner container for the purpose of connecting, as needed, a removal fixture (flap valve).

The transport and storage container for liquids has the following advantages:

The configuration of the inner container as a flexible container which is comprised of an inner envelope of plastic foil and an outer envelope of a woven material, makes it possible, in comparison to liquid containers with an inner container that is blow-molded of plastic material, to provide a reduction of the tare weight and of the transport costs due to the reduced thickness of the foil and of the woven material and a considerable reduction of the plastic material contaminated by paints, lacquers, and similar environmentally dangerous liquids so that the disposal of this plastic material can be realized without problems. The transport container can be reconditioned by a simple exchange of the inexpensive inner container at the manufacturing and filling facilities for liquid goods in an inexpensive way, wherein the minimal space requirement of the flexible inner container as a result of its foldability and the lower manufacturing costs of the inner container provide inexpensive stock holding. The manufacture of the flexible inner container of a plastic foil and a woven material, preferably of plastic material, is more costefficient than the manufacture of the blow-molded plastic inner container by means of expensive blow-molding machines which require high investment costs. Finally, the holding device, to be fastened at the inner side of the cage to a horizontal cage rod, for the inner container outflow socket to which a removal armature can be connected, corresponds to the prescribed transport safety requirements for liquid containers furnished with a flexible inner container.

DESCRIPTION OF THE PREFERRED EMBODIMENTS

Figure 1:
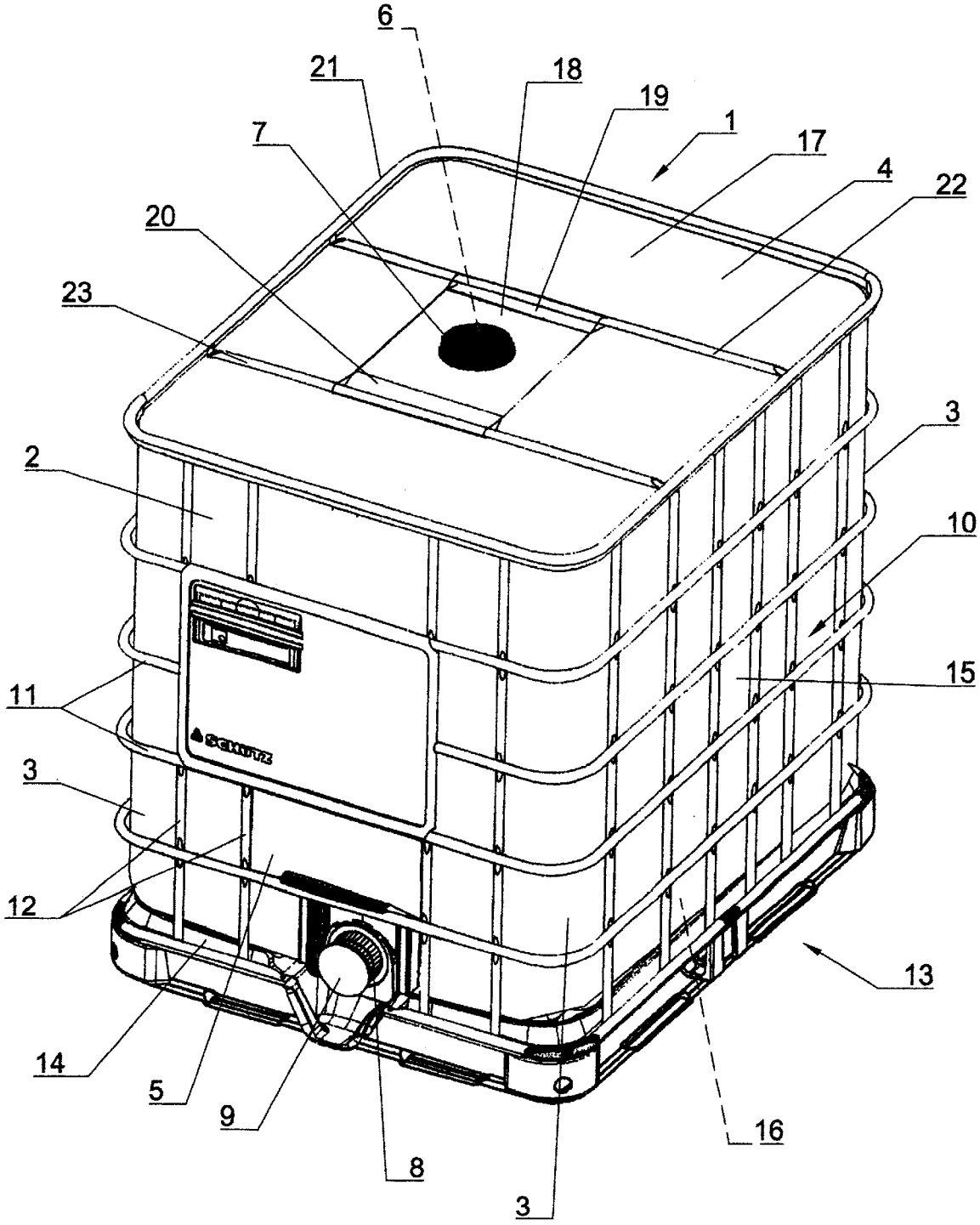
FIG. 1 is a perspective representation of the transport and storage container.

The transport and storage container 1 according to FIG. 1 for liquids, which can be used as a single-use or multi-use container, has main components in the form of an inner container 2, which is exchangeable, flexible, and of a parallelepipedal shape with rounded corners 3, an inner envelope 4 made of a plastic foil material, for example, a polyethylene foil, and an outer envelope 5 for reinforcing the inner envelope 3 and made of a transparent woven material, for example, a polyamide fiber. The inner container 2 is provided with a fill socket 6 to be closed by a screw lid 7 and an outflow socket 8 to be closed by a screw lid 9 and configured to have a removal faucet connected thereto. The container 1 is further provided with a cage 10 of crossing horizontal and vertical cage rods 11, 12 of metal as well as a pallet-like underframe 13 of metal with length and width dimensions meeting European "Euronorm" standards. The underframe 13 is configured to be handled by means of a stacker truck, shelf servicing devices or the like and has a flat bottom tub 14 for a positive-locking reception of the inner container 2 filled with a liquid.

The outer envelope 5 of the inner container 2 is comprised of tailored mantle, bottom, and cover pieces 15, 16, 17 which are sewn or glued to welded edge strips of the inner envelope 4. A tailored piece 18, having edges formed to loops 19, 20 for suspending the inner container from cover rods 22, 23 connected to the upper frame 21 of the cage 10 of the transport container 1 is welded, onto the tailored piece of the inner envelope 4 of the inner container 2.

The outflow socket 8 of plastic material has a welding flange 24 and is welded with it to the edge area of the outflow opening 25 of the flexible inner container 2.

Figure 2:
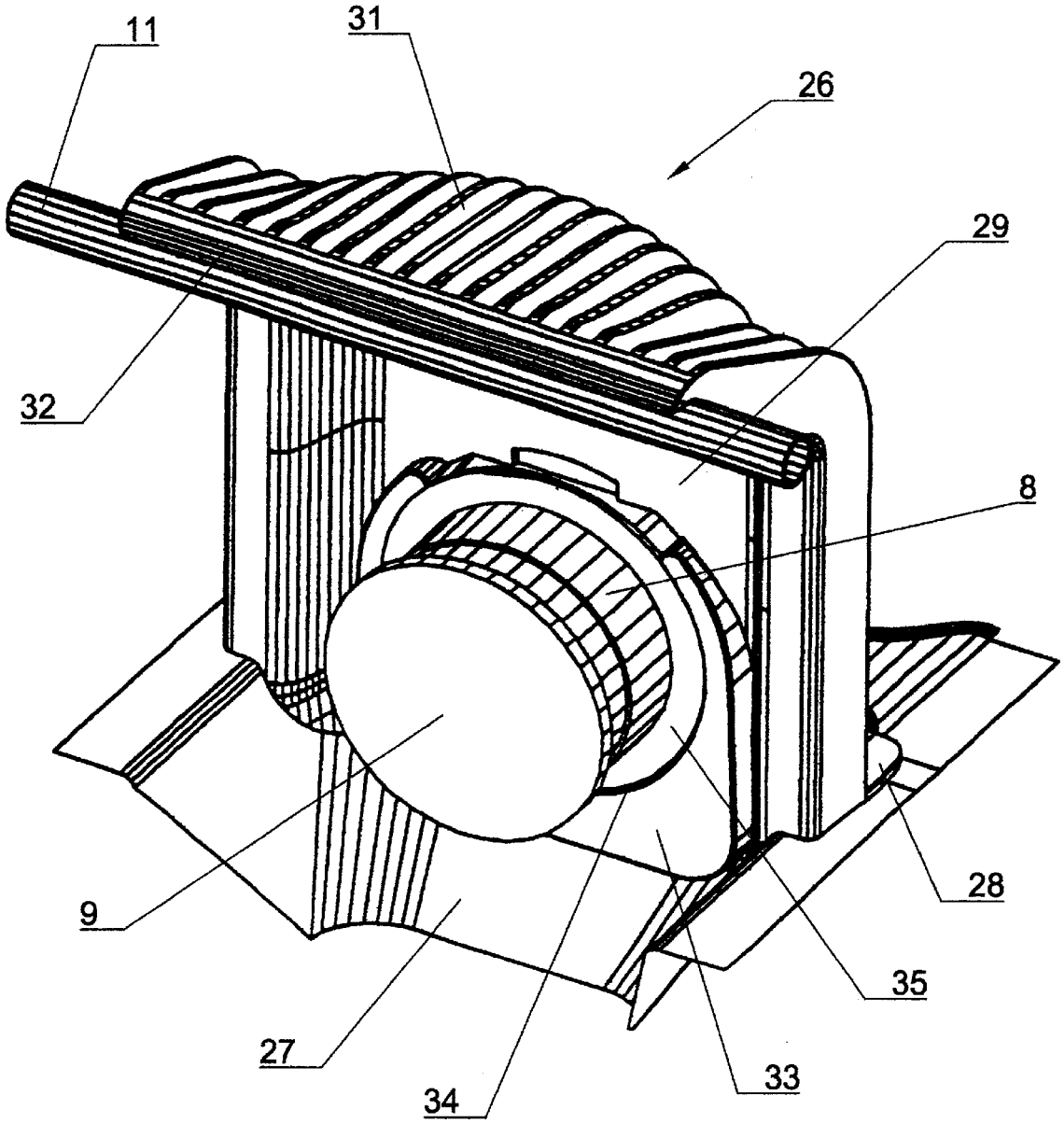
FIG. 2 is a perspective front view of the securing device for the outflow socket of the container according to FIG. 1.
Figure 3:
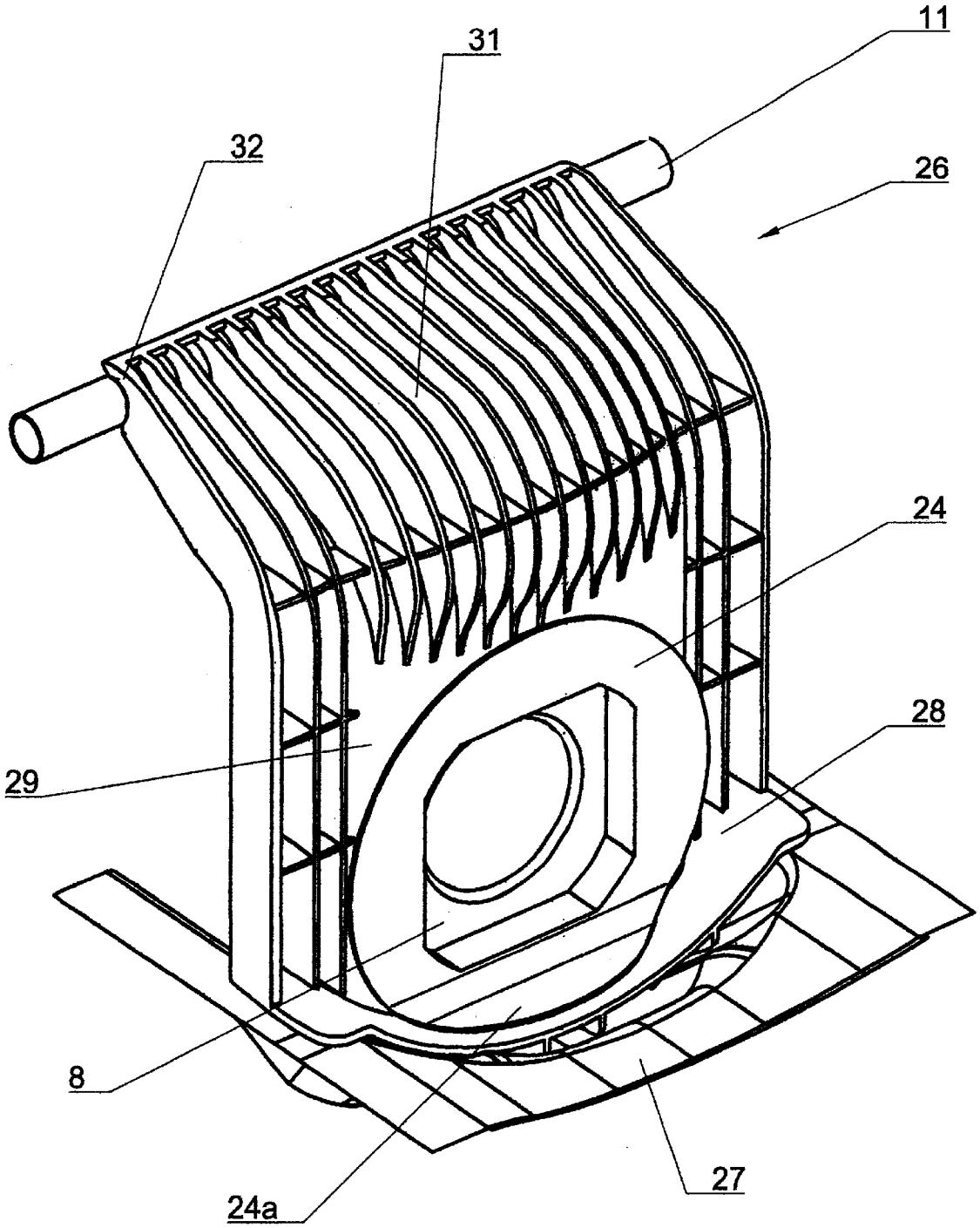
FIG. 3 is a perspective rearview of the holding device according to FIG. 2.
Figure 4:
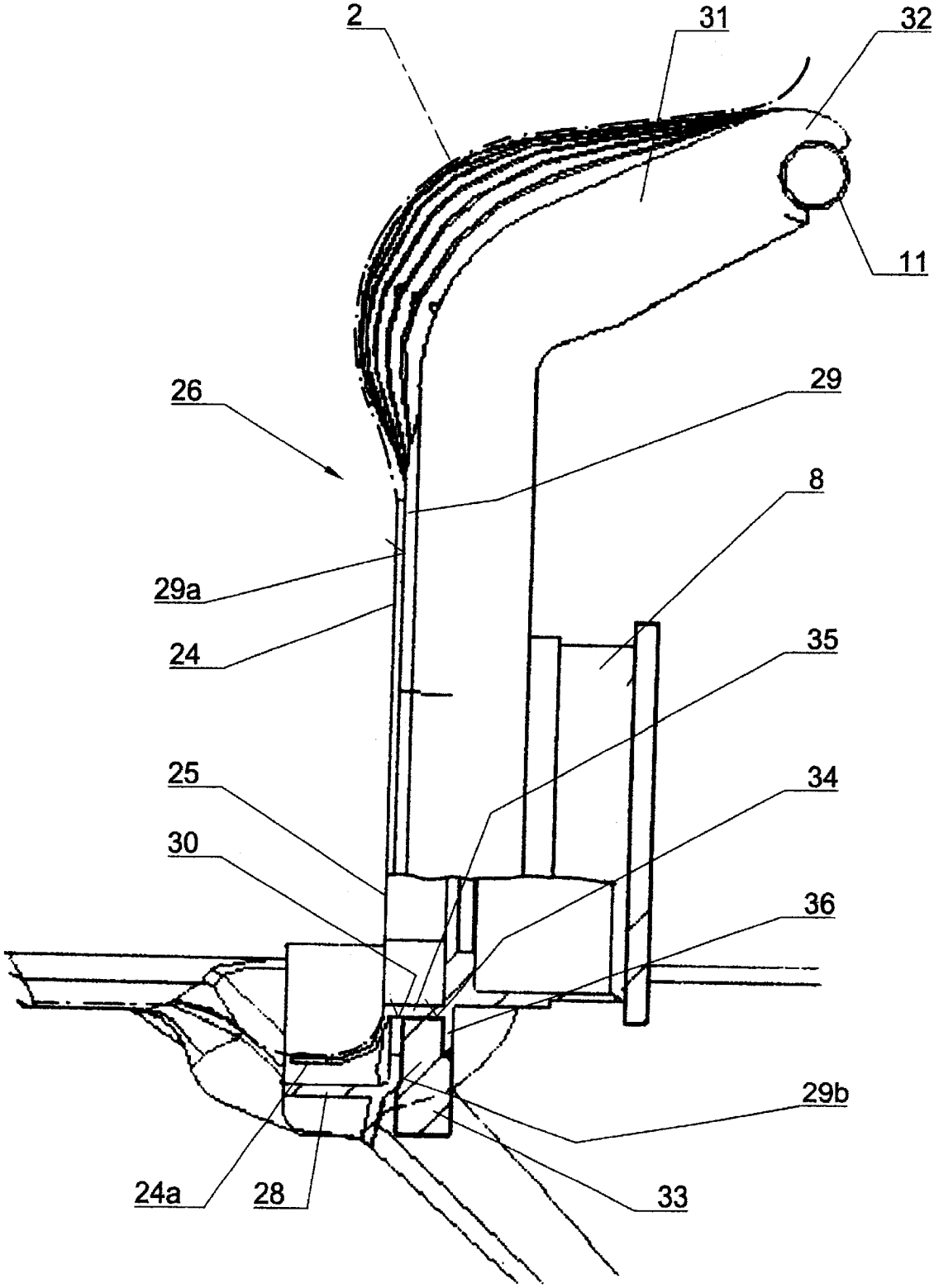
FIG. 4 is a partial longitudinal section of the holding device.
Figure 5:
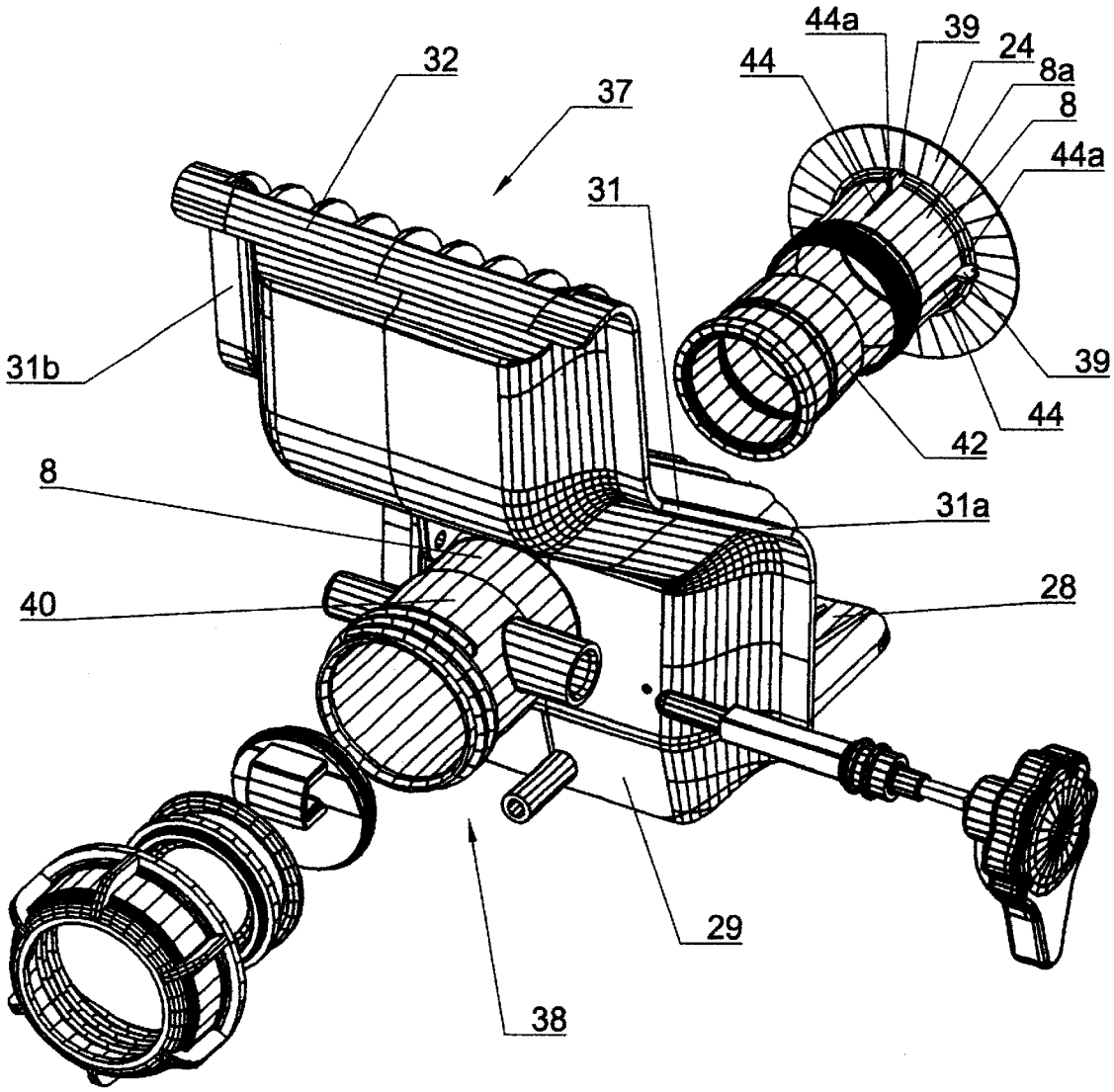
FIG. 5 is an exploded view of the holding device for the outflow socket of the container according to FIG. 1 with a flap valve.
Figure 6:
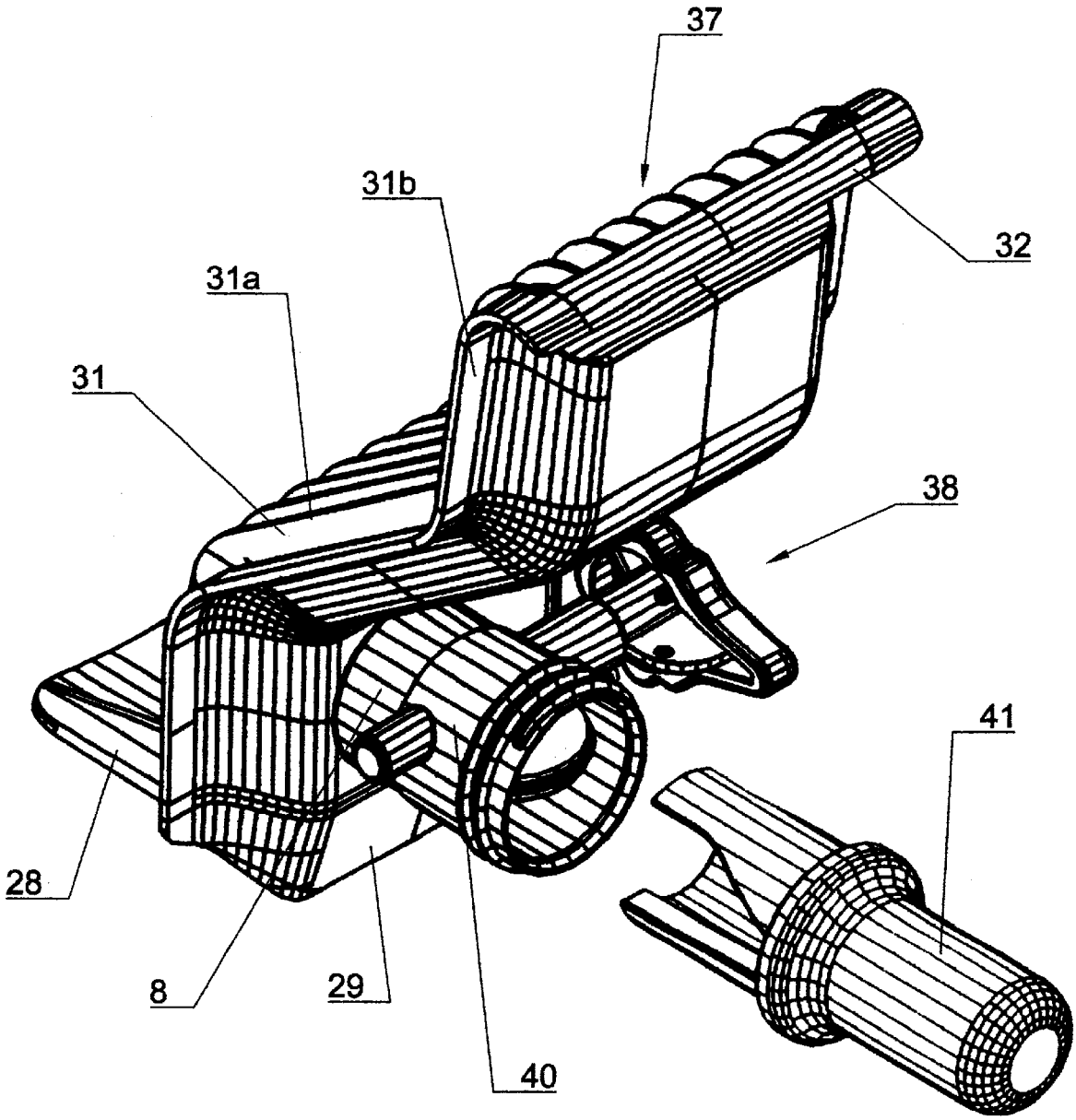
FIG. 6 is a perspective view of the holding device, of the outflow socket, and of the flap valve in the finish-mounted state.
Figure 7:
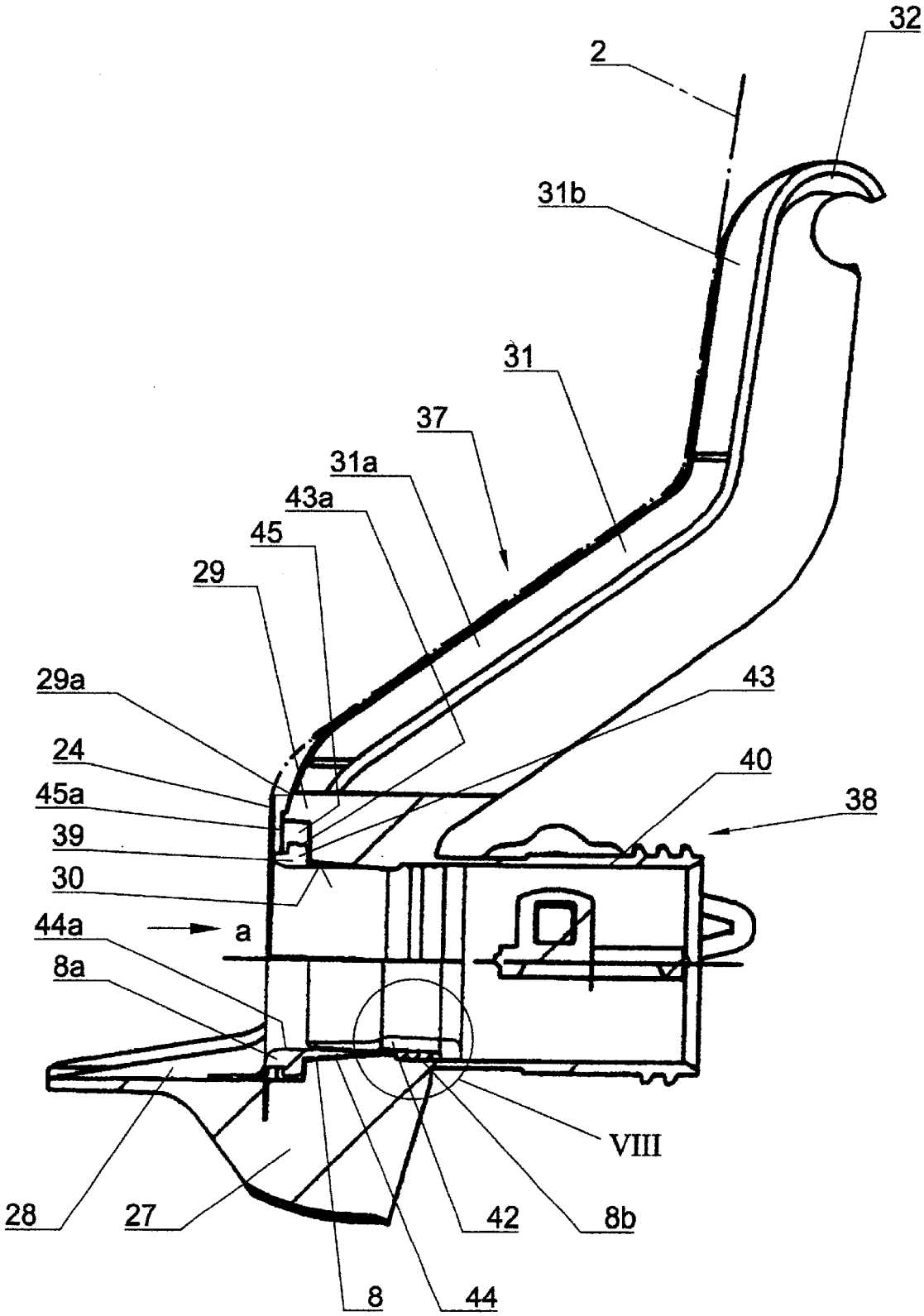
FIG. 7 is a longitudinal section of the holding device and the mounted outflow socket with connected flap valve.
Figure 8:
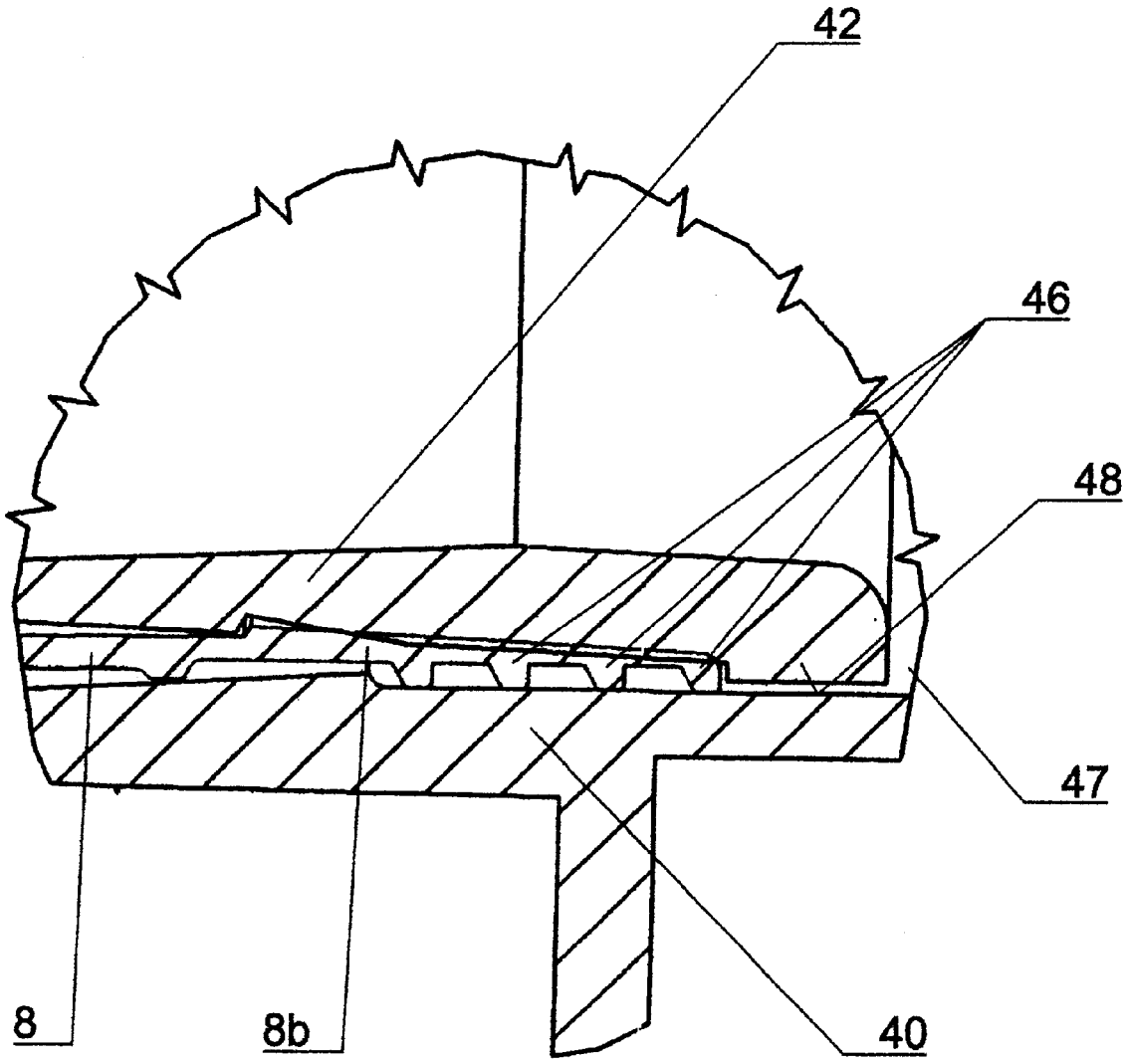
FIG. 8 is a view of the detail VIII of FIG. 7 on an enlarged scale.

The outflow socket 8 of the inner container 2 is detachably connected with a holding device 26, illustrated in FIGS. 2 to 4, to the cage 10 of the transport container 1. The holding device 26, injection-molded of plastic material, has a lower part 28 resting on the outlet area 27 of the bottom tub 14 of the underframe 13 of the transport container 1, a support plate 29 perpendicularly extending to the lower part 28 and having a through opening 30 for the outflow socket 8 of the inner container 2, and a support leg 31 projecting outwardly from the support plate 29 in a roof-shaped way for supporting the flexible inner container 2. The support leg 13 of the holding device 26 has a hookshaped outer edge 32 for attachment of the holding device 26 on a horizontal cage rod 11 of the cage 10 of the transport container 1.

The outflow socket 8 of the inner container 2, which is pushed with play from the inner side of the cage 10 of the transport container 1 through the through opening 30 in the support plate 29 of the holding device 26, rests against the welding flange 24 at the inner side 29*a* of the support leg 29 and is secured against detachment from the holding device 26 by a holding plate 33 which can be slipped captively with a corresponding opening 34 onto a projection 35 of the outflow socket 8 at the outer side 29*b* of the support plate 29 and engages a ring shoulder 36 on the projection 35 of the outflow socket 8.

The outflow socket 8 of the inner container 2 seated in the through opening 30 of the holding device 26 is supported with a projecting lower edge 24*a* of the welding flange 24 on the lower part 28 of the holding device 26 and is secured against rotation in the through opening 30.

FIGS. 5 through 8 show a holding device 37 with the outflow socket 8 inserted therein. A flap valve 38 as a removal fixture provided on the transport and storage container 1 for liquids according to FIG. 1 is connected to the outflow socket 8.

The holding device 37 according to FIGS. 5 through 8, injection-molded of plastic material, has a shape slightly changed relative to the holding device 26 according to FIGS. 2 to 4. It has a lower part 28 resting on the outflow area 27 of the bottom tub 14 of the underframe 13 of the transport container 1, a support plate 29 extending perpendicularly from the lower part 28 and having a through opening 30 for the outflow socket 8 of the inner container 2, and a support leg 31 projecting outwardly from the support plate 29 in a roof-shaped way for supporting the flexible inner container 2. The support leg 31 is divided into a slantedly upwardly oriented portion 31*a* adjoining the support plate 29 and a portion 31*b* slightly slanted relative to the vertical adjoining the portion 31*a* which has a hook-shaped outer edge 32 for attachment of the holding device 37 on a horizontal cage rod 11 of the cage 10 of the transport container 1.

The outflow socket 8 which is positioned with play in the through opening 30 of the support plate 29 of the holding device 37 rests with the welding flange 24 against the inner side 29*a* of the support plate 29. The outflow socket 8 has at its inner end 8*a* several locking elements 39 for locking the socket 8 at the holding device 37 against detachment from the through opening 30 in the support plate 29 of the holding device 37.

The plastic housing 40 of the flap valve 38 is slipped onto the outer elastically widenable end 8*b* of the outflow socket 8 and is clamped onto the outflow socket 8, for example, by means of a clamping sleeve 42 of plastic material pressed into the socket end 8*b* by means of a bolt 41.

The locking elements 39 are formed as locking noses 43 which are distributed about the periphery on the inner end 8*a* of the outflow socket 8 and are arranged spring-elastically at the free end 44*a* with limitation of the spring action in the radial direction by spring tongues 44 integrated into the inner end 8*a* of the outflow socket 8. In the mounted state of the outflow socket 8 the locking noses 43 engage an annular groove 45 of the support plate 29 of the holding device 37.

The locking noses 43 have a gliding edge 43*a* upwardly inclined counter to the insertion direction a and gliding, during insertion of the outflow socket 8 from the inner side of the cage 10 of the transport container 1 through the through opening 30 of the holding device 37, on the inner edge 45*a* of the annular groove 45 of the holding device.

When the clamping sleeve 42 is correspondingly sized, it can exert a spreading action onto the spring tongues 44 with the locking noses 43 for locking the outflow socket 8 with the holding device 37.

The outer end 8*b* of the outflow socket 8 has annular projections 46, arranged at a spacing relative to one another, or a thread which, together with the wall 48 of the cylindrical through opening 47 of the housing 40 of the flap valve 38, provide(s) a labyrinth seal.

While specific embodiments of the invention have been shown and described in detail to illustrate the inventive principles, it will be understood that the invention may be embodied otherwise without departing from such principles.

What is claimed is:

1. A transport and storage container for liquids, the container comprising:

a pallet underframe configured to be handled by various transport devices;

a flexible inner container of plastic material with a closeable fill socket and a closeable outflow socket of plastic material;

a cage resting against the inner container and comprised of crossing horizontal and vertical cage rods of metal;

a holding device detachably connected to the cage and configured to receive the outflow socket of the inner container, wherein the outflow socket is configured to receive a removal fixture.

2. The container according to claim 1, wherein the holding device comprises a lower part resting on the pallet underframe of the transport container, a support plate having a through opening configured to receive the outflow socket, wherein the support plate is connected to the lower part and projects upwardly from the lower part, and a support leg connected to the support plate so as to project outwardly in a roof-shape from the support plate and configured to support the flexible inner container, wherein the support leg has a hook-shaped outer edge configured to attach the holding device to one of the horizontal cage rods of the cage.

3. The container according to claim 1, wherein the outflow socket has a welding flange configured to be welded to an edge area of an outflow opening of the inner container.

4. The container according to claim 1, wherein the outflow socket has a rotational safety device configured to secure the outflow socket in the through opening of the holding device.

5. The container according to claim 1, wherein the outflow socket, inserted with play in the through opening of the holding device, has a welding flange and rests with the welding flange against an inner side of the support plate of the holding device, wherein the holding device comprises a securing plate and wherein the outflow socket is secured against detachment by the securing plate at the outer side of the support leg, wherein the securing plate has an opening configured to be slipped captively onto a projection of the outflow socket by engaging an annular shoulder of the projection of the outflow socket.

6. The container according to claim 1, wherein the outflow socket, inserted into the through opening of the holding device, has a welding flange and rests with the welding flange against an inner side of the support plate of the holding device, wherein the outflow socket has an inner end with one or more locking elements configured to lock the outflow socket with the holding device, wherein the outflow socket has an outer, elastically widenable end, wherein the removal fixture to be received by the outflow socket has a housing configured to be slipped onto the outflow socket and secured on the outflow socket by means of a clamping sleeve pressed into the outer end of the outflow socket.

7. The container according to claim 6, wherein the inner end of the outflow socket has locking noses distributed about the periphery of the inner end, wherein the locking noses are configured to be spring elastic to a limited extent in a radial direction and, in the mounted state of the outflow socket, engage an annular groove of the holding device.

8. The container according to claim 7, wherein the inner end of the outflow socket has spring tongues and wherein the locking noses are arranged at free ends of the spring tongues.

9. The container according to claim 6, wherein the locking noses have a gliding edge upwardly inclined counter to an insertion direction of the outflow socket and gliding, during insertion of the outflow socket from the inner side of the cage through the opening of the holding device, on an inner edge of an annular groove of the holding device.

10. The container according to claim 6, wherein the clamping sleeve is configured to exert a spreading action onto the spring tongues with the locking noses for locking the outflow socket on the holding device.

11. The container according to claim 6, wherein the outer, elastically widenable end of the outflow socket has annular projections, spaced from one another, or a thread, wherein the annular projections or the thread forms a labyrinth seal together with the wall of a cylindrical through opening of the housing of the removal fixture.

12. The container according to claim 1, wherein the holding device for the outflow socket of the inner container is injection-molded of plastic material.

* * * * *